United States Patent [19]

Harwood

[11] Patent Number: 5,032,958

[45] Date of Patent: Jul. 16, 1991

[54] CORNICE LIGHTING SYSTEM

[76] Inventor: Ronald P. Harwood, 31110 Applewood, Farmington Hills, Mich. 48018

[21] Appl. No.: 513,648

[22] Filed: Apr. 24, 1990

[51] Int. Cl.[5] ..... F21S 3/02

[52] U.S. Cl. ..... 362/217; 362/297; 362/301; 362/346; 362/347

[58] Field of Search ..... 362/217, 219, 260, 297, 362/298, 301, 346, 347, 812, 125

[56] References Cited

U.S. PATENT DOCUMENTS

| | | | |
|---|---|---|---|
| 2,507,350 | 5/1950 | Russell, Jr. | 362/219 X |
| 2,717,954 | 9/1955 | Rex | 240/25 |
| 2,932,728 | 4/1960 | Thomas | 362/219 |
| 3,012,132 | 12/1961 | Rosenfield | 362/219 |
| 3,679,893 | 7/1972 | Shemitz et al. | 240/103 |
| 4,081,667 | 3/1978 | Lewis | 362/296 |
| 4,229,779 | 6/1980 | Bilson et al. | 362/217 |
| 4,517,631 | 5/1985 | Mullins | 362/346 |
| 4,519,019 | 5/1985 | Hall | 362/147 |
| 4,712,165 | 12/1987 | Cetrone | 362/219 X |
| 4,725,931 | 2/1988 | Bourdon | 362/217 X |
| 4,748,543 | 5/1988 | Swarens | 362/147 |
| 4,858,087 | 8/1989 | Hartshorn | 362/219 |

*Primary Examiner*—Ira S. Lazarus
*Assistant Examiner*—Sue Hagarman
*Attorney, Agent, or Firm*—Dykema Gossett

[57] ABSTRACT

A lighting fixture of the wall wash type and being parabolic in cross-section is disclosed which has interchangeable reflector elements for directing light in any desired direction together with snap-in quickly interchangeable lighting fixtures to provide for the use of fluorescent lighting, tracking lighting, incandescent lighting or the like. The lighting fixtures are adaptable to be "ganged" together seriatim in any number needed to provide for the fixture to be of any desired length. Unique power transfer means are provided to provide for electrically connecting the joined lighting fixtures.

35 Claims, 5 Drawing Sheets

CORNICE LIGHTING SYSTEM

BACKGROUND OF THE INVENTION

The present invention relates to lighting fixtures, and more particularly to lighting fixtures of the type commonly known as "cornice" lighting fixtures which are designed to be mounted above and spaced some finite distance out from a wall surface which it is desired to illuminate. The "cornice" lighting fixture is specially designed to provide a uniform illumination or "wash" to the wall being illuminated.

DESCRIPTION OF THE PRIOR ART

Practically since the advent of the retailing art, there has been a need for a low-cost, efficient way to provide uniform illumination of a wall surface against which retail goods are to be displayed. Quite commonly, such wall surfaces are illuminated either by having a light mounted in the ceiling spaced out a few feet from the wall, or having a fixture mounted as a cornice on a display fixture.

Fluorescent lighting has been predominant in its use in an attempt to provide such illumination due to its high efficiency, reliability, economy and versatility. However, along with the advent fluorescent lighting for use in such illumination, two problems arose which have, up until the time of the present invention, defied solution. These problems are (a) non-uniform illumination, which usually manifests itself in a noticeable decrease in illumination toward the lower portions of the wall due to the greater distance from the fixture and the sharper angle of light incidence, and (b) scalloping of the upper fringe of the illuminated areas due to an uneven combination of illumination from the adjacent fixtures.

Among the attempts which have been made to solve these problems are the solutions described in U.S. Pat. No. 4,748,543 to Ralph W. Swarens, entitled "Hidden Source Fluorescent Light Wash Fixture," and that disclosed in U.S. Pat. No. 3,679,893 to Shemeltz et al., entitled "Luminary Reflector Comprising Elliptical and Parabolic Elements", which is the closest prior art of which I am aware. However, these attempted solutions to the problems have produced problems of their own. The combination of elliptical and parabolic segments as shown in the Shemeltz et al. patent to provide a uniform wall wash over a large distance has produced a rather bulky device which is not easily mountable in a ceiling or cornice, and is limited to use as disclosed on the floor of the retail establishment in most instances.

The lighting fixture disclosed in the patent to Swarens is one which is mountable in multiple locations, but is a light fixture which, is still rather bulky which in addition, once installed, cannot be easily modified when displays are changed, which happens fairly frequently in retail establishments.

These difficulties have led to calls to those in the lighting from the industry to provide a lighting fixture which is capable of producing a uniform wall wash, can easily be modified to meet changing lighting needs, and can accommodate various types of light fixtures to accomplish those lighting needs.

SUMMARY OF THE INVENTION

In order to largely eliminate the problems present in the prior art, I have provided a novel cornice lighting fixture having interchangeable reflector elements which may be elliptical, parabolic or of other shape to direct the light exactly where it is desired, and which has snap-in, quickly interchangeable lighting fixtures to provide for the use of fluorescent lighting, track lighting, incandescent lighting or other types of lighting in the same fixture body without any modification thereto. In addition, I provide for "ganging" such fixtures together in any number needed to provide for the fixture to be of any desired length.

The result is a lighting fixture which can easily be mounted in the ceiling or as a cornice on a display unit to provide uniform wall wash and which can have its reflector portions and/or lighting portions interchanged, practically at will, to meet rapidly changing lighting requirements.

Thus, one of the objects of the present invention is to provide an improved lighting fixture mountable in a wide variety of locations to provide a uniform "wall wash" where needed.

A further object of the present invention is to provide a cornice lighting fixture whose reflector shape is easily changed to meet changing lighting needs.

A still further object of the present invention is to provide a lighting fixture which produces a uniform wall wash when used with a fluorescent lighting module but which can also produce spotlight effects when said fluorescent lighting module is replaced with a track lighting module.

A still further object of the present invention is to provide for a lighting fixture which may be changed to meet various lighting requirements without disruption of the retail environment while doing so.

A still further object of the present invention is to provide a fluorescent wall wash lighting fixture which may easily be ganged together to produce lights of varying length.

A still further object of the present invention is to provide a fluorescent light wash fixture which is relatively light in weight to provide for mounting the same in various locations.

A still further object of the present invention is to provide a fluorescent light wash fixture having interchangeable reflector elements.

A still further object of the present invention is to provide a light wash fixture to which signage can be mounted and illuminated thereby.

A further object of the present invention is to provide a lighting system comprising a plurality of lighting fixtures which are joined seriatim by joiners which fit in joiner mounting slots formed in the lighting fixture body.

Further objects and advantages of the present invention will become apparent from the following description and appended claims, reference being made to the accompanying drawings forming a part of the specification, wherein like reference characters designate corresponding parts in the several views.

It is to be understood that the present invention is not limited to the details of construction and arrangement of parts illustrated in the accompanying drawings, since the invention is capable of other embodiments and of being practiced or carried out in various ways within the scope of the claims. Also, it is to be understood that the phraseology and terminology employed herein is for the purposes of description and not of limitation.

DETAILED DESCRIPTION OF THE PREFERRED EMBODIMENTS

Figure 1:
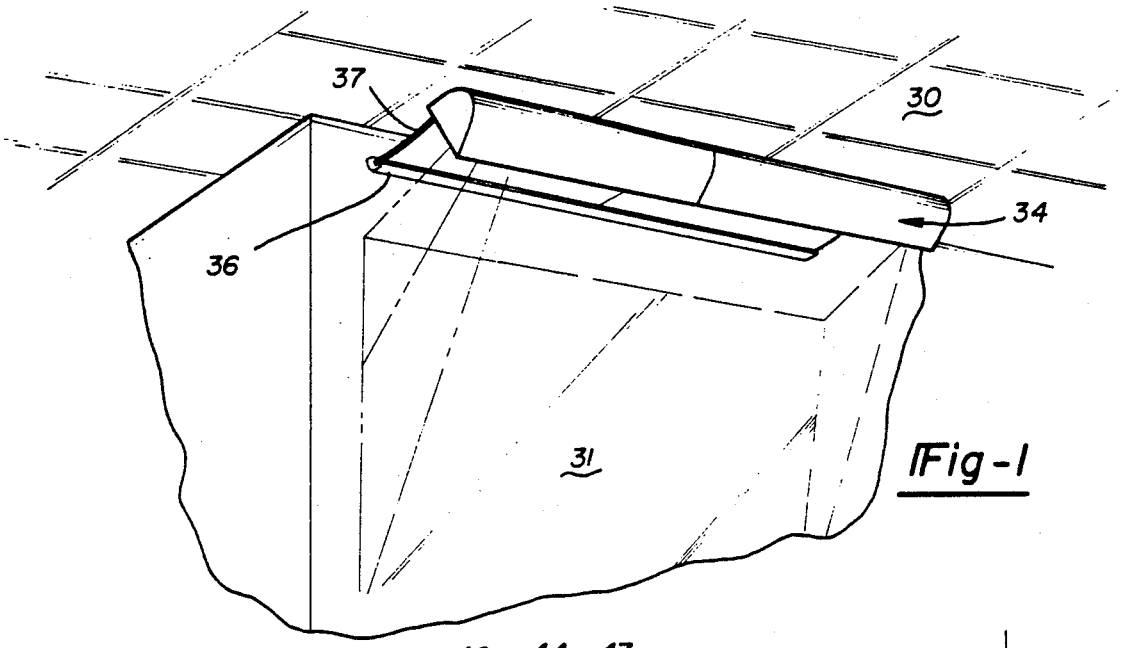
FIG. 1 is a pictorial view partially broken away showing a construction embodying the present invention installed in a retailing establishment.

Referring now to FIG. 1, there is shown a construction embodying the present invention as it may be installed in a typical retailing establishment. In such an establishment, there is normally a ceiling 30 having recessed lighting (not shown) installed therein. A lighting fixture embodying the present invention and generally designated by the numeral 34 may be mounted to the wall 31 by the clip 36 and support means 37. It should be understood that there are many means of mounting the present invention, some of which constitute part of the present invention and will be described and claimed herein, and some of which are old and well-known in the art, in such instance forming no part of the present invention. Any practicable means may be used to mount the lighting fixture 34 in any desired location.

Referring now to FIG. 2, there is again shown the lighting fixture, generally designated by the numeral 34, and including a lighting fixture body 35 having an interior 35A, and an exterior 35B, and being generally of a parabolic shape, having an upper portion 40, an extended lower portion 41, and a mid-portion 42. Formed integrally with the lighting fixture body 35 in the exterior 35B thereof is an exterior mounting slot 43 in which a joiner 44 is positioned. The joiner 44 has a stud 45 welded thereon which passes through a hole 46 provided in the support means 37 which is attached by means of clip 36 to the wall 31. A nut 47 tightened onto the stud 46 holds the fixture body 35 in place.

Figure 2:
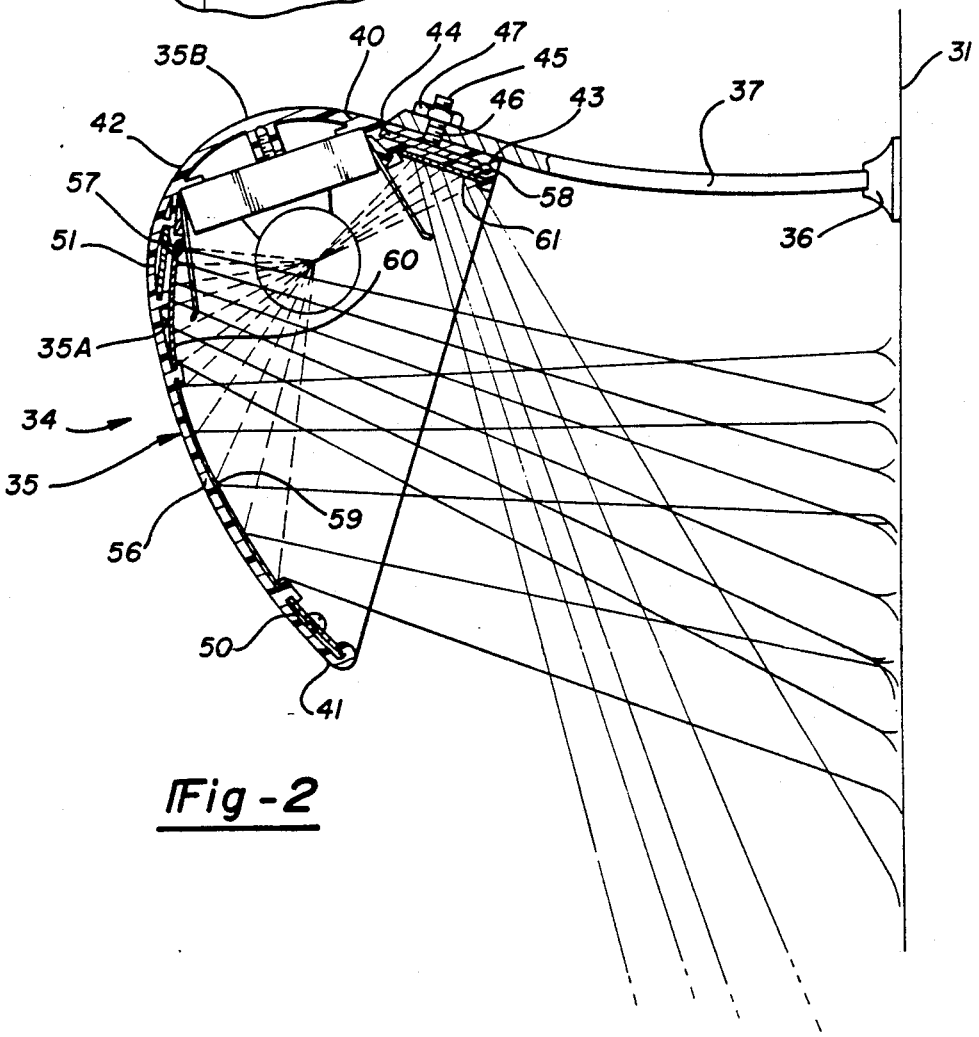
FIG. 2 is a sectional view of the lighting fixture shown in FIG. 1.
Figure 3:
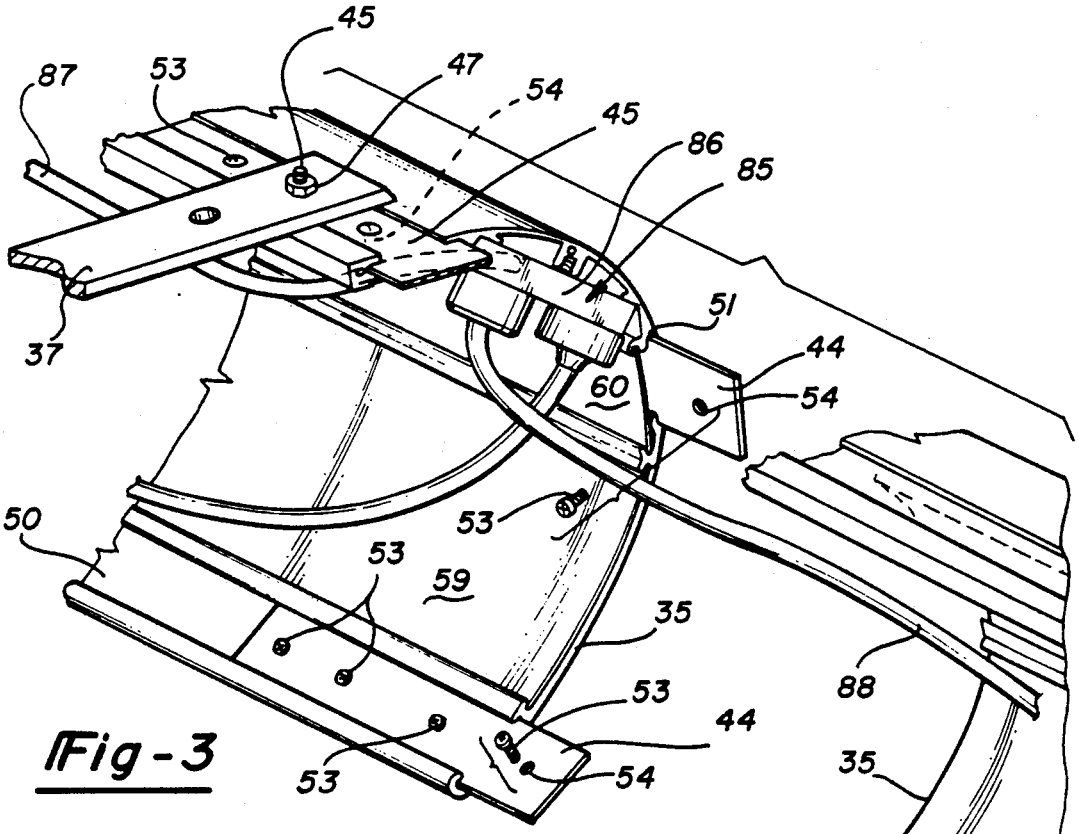
FIG. 3 is a partial exploded view showing how the lighting fixtures of FIG. 1 are joined together, and how power is transmitted between lighting fixtures.
Figure 4:
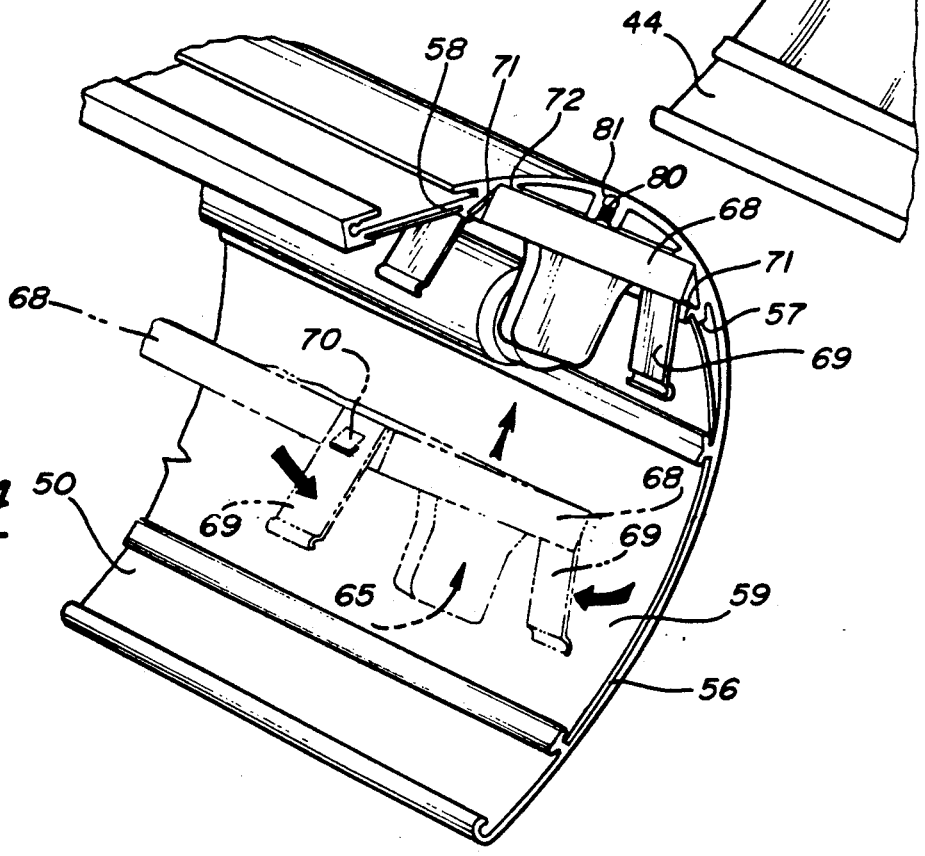
FIG. 4 is a partial perspective view showing how the lighting modules "snap" into the lighting fixture body of the fixture shown in FIG. 3.

Referring now to FIGS. 2–4, formed integrally on the interior 35A of lighting fixture body 35 and being integral therewith is a first joiner slot 50, and proximate the mid-portion 42 of the fixture body 35 on the interior 35A thereof is a second joiner slot 51. As can be seen from FIG. 3, to join two fixture bodies 35 together, it is only necessary to slip joiners 44 into the first and second joiner slots 50 and 51 respectively, and tighten them in place by the means of the screws 53 bein threadably engaged with the holes 54 therein. As many light fixtures as desired may be joined seriatim in this fashion. As illustrated also in FIG. 3, the support means 37 is attached by the nut 47 to the stud 45 which is welded onto the joiner 44 which also has a plurality of screws 53 threadably engaging holes 54 to hold the joiner in place. It should be understood that while in the preferred embodiment the exterior mounting slot 43, the first joiner slot 50 and second joiner slot 51 are formed integrally with the fixture body 35, it is well within the scope of the claims of the present invention to provide that the slots not be formed integrally, or that other mounting means be provided for the joiners.

Also formed integrally with the lighting fixture body 35, but capable of being formed in other ways also, are a first reflector mounting slot 56, second reflector mounting slot 57 and third reflector mounting slot 58. The first reflector mounting slot 56 is formed on the interior 35A of the fixture body 35 adjacent the first joiner slot 50, while the second reflector mounting slot 57 is formed proximate the mid-portion 42 of the fixture body 35, also on the interior 35A thereof and above the second joiner mounting slot 51, while the third reflector mounting slot 58 is formed proximate the upper portion 40 of the fixture body 35 on the interior 35A thereof, generally opposite the exterior mounting slot 43.

Of particular importance to the present invention are two central concepts. First of all, any or all of these reflectors may be used as needed. In the preferred embodiment of the invention, the first reflector 59 and the third reflector 61 are parabolic in shape, while the second reflector 60 is elliptical in shape, thus performing a uniform wall wash under most circumstances. However, because of the location and formation of the reflector mounting slots, the shape of any or all of the reflectors may be changed to meet particular lighting needs without the need to discard or extensively modify the lighting fixture body 35, thus providing distinct advantages over the prior art in this field, and solving longstanding problems in that art. For example, when one wants to wash a flat, vertical wall surface, one gets the advantages of the constructions mentioned earlier without the bulk, and without being limited to a fixed reflector configuration should one want to later illuminate with the same fixture a wall, for example, having a curvilinear portion. The shape of one or all of the first, second and third reflectors may be modified without modifying the fixture body and at very little expense, all the while being able to join several fixtures seriatim which is not provided for in either the Shemitz or Swarens constructions.

Referring now to FIGS. 2–6, another advantage of the present invention can be seen. It is contemplated that in most lighting applications, it will be desired to use a fluorescent light to provide the wall wash illumination desired. To provide the illumination, a lighting module generally designated by the numeral 65 is provided which contains a fluorescent tube 66 and a power cord 67 together with the normal accompaniments of fluorescent lighting such as the ballast and other items which, for ease of explanation, are contained within the lighting module 65, but not shown. The lighting module 65 will normally have a base 68 to which at least one pair of spring arms 69 are mounted. The spring arms 69 will each have bosses 70 which are adapted to snap into a first pair of ridges 71 formed in a 180° opposed relationship and being spaced a distance from a second pair of opposed ridges 72 formed integrally with said fixture body 35 on the interior 35A thereof to provide an abutment means for said lighting module 65.

Figure 5:
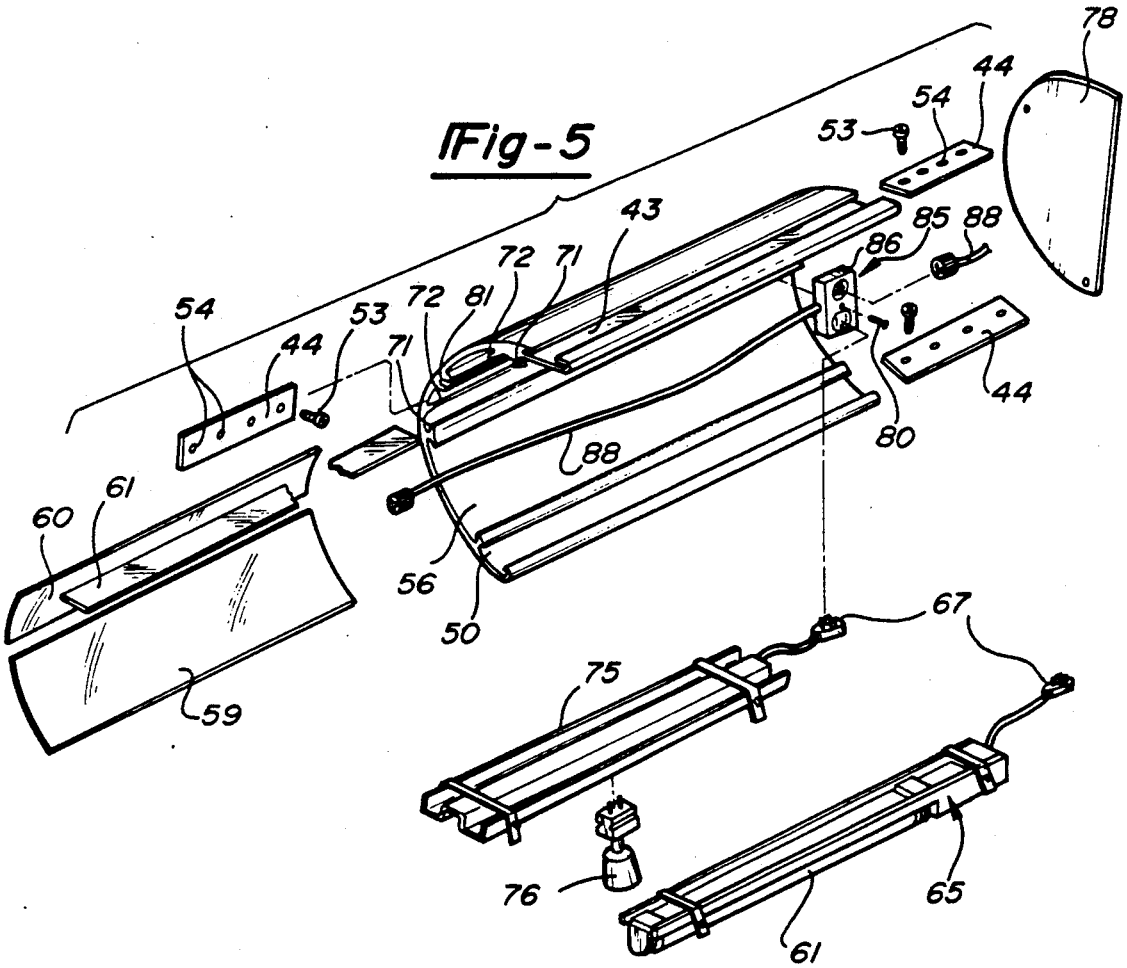
FIG. 5 is an exploded view of a complete lighting fixture construction embodying the present invention.
Figure 6:
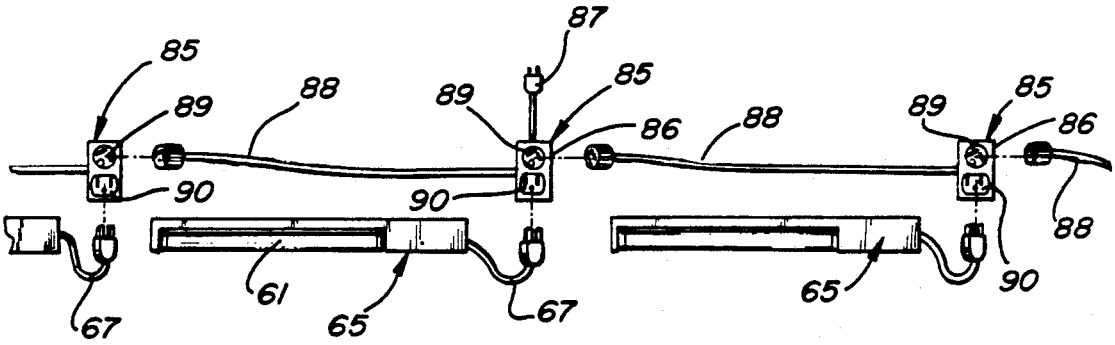
FIG. 6 is a pictorial view showing how power is transmitted between lighting fixtures.

One of the advantages of the present invention over prior art constructions is the ability to provide interchangeable lighting modules. As shown in FIG. 5, if the lighting module 65 having the fluorescent tube 61 is not desired, the lighting module 65 may take the form of a lighting track 75 having a track light 76 mounted thereon. As before, the spring arms 69 having bosses 70 therein will snap into the first pair of ridges 71 formed integrally with the fixture body 65 on the interior thereof in a 180° opposed relationship. In the preferred embodiment, one of the first pair of ridges 72 also will form a portion of the second reflector slot 57, while the other forms a portion of the third reflector slot 58.

If desired, the lighting modules 65 or 75 may be fastened for extra holding power by means of a screw 80 to the screw receiving slot 81 formed proximate the mid-portion of the fixture receiving means, said fixture receiving means comprising the first pair of ridges 71 and the second pair of ridges 72. To provide power to the lighting fixtures, whether mounted singly or joined together seriatim, each lighting fixture is provided with a power supply means generally designated by the numeral 85. The dimensional relationship between the length of the fixture body 35, the lighting module 65 and the power supply means 85 are important. The length of the lighting module 65 must be sufficiently shorter than the length of the lighting fixture body 35 so that the outlet box portion 86 of the power supply means 85 may be mounted adjacent the lighting module 65 (or 75) in each lighting fixture. While the length of the lighting modules 65, 75 may be any dimension less than the length of the fixture body 35 minus the length of the outlet box portion 86, it is generally desirable to keep the lighting modules as long as possible to provide for as much light source as possible. Each of the power supply means 85, except generally the first in the series, which would have a power intake cord 86 in addition to the other parts to be described, to receive power from an outside power source will have a power supply cord 88 to receive power from an adjacent upstream lighting fixture, a first receptacle 89 being electrically connected to the power supply cord 88, and a second receptacle 90, also electrically connected to the power supply cord 88, to supply power to the lighting module, such as 65. While the second receptacle 90 may be a standard three-prong outlet, it is preferred that the first receptacle 89 be of a quick-disconnect type for ease of installation and maintenance. For permanency of connection, the outlet box 86 is generally fastened in the fixture receiving means by fastening the same at one end of the fixture body 35 against the second ridges 72 by means of a screw 80 being fastened to the screw receiving slot 81.

Figure 8:
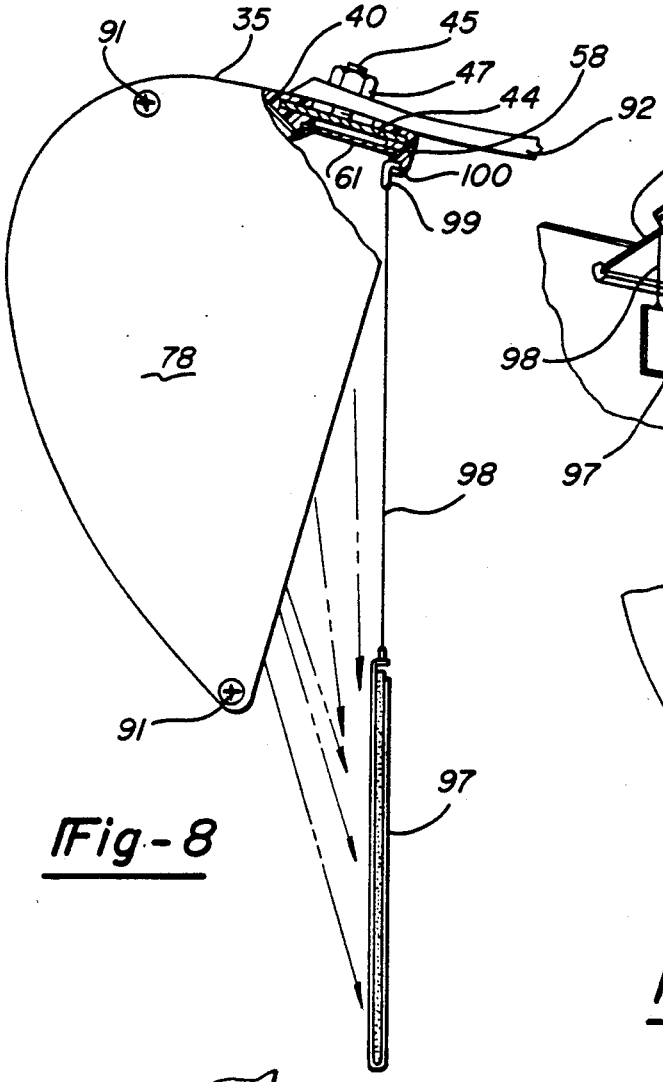
FIG. 8 is an elevational view partly in section showing how a sign may be hung from a lip provided in the upper portion of the fixture body.
Figure 12:
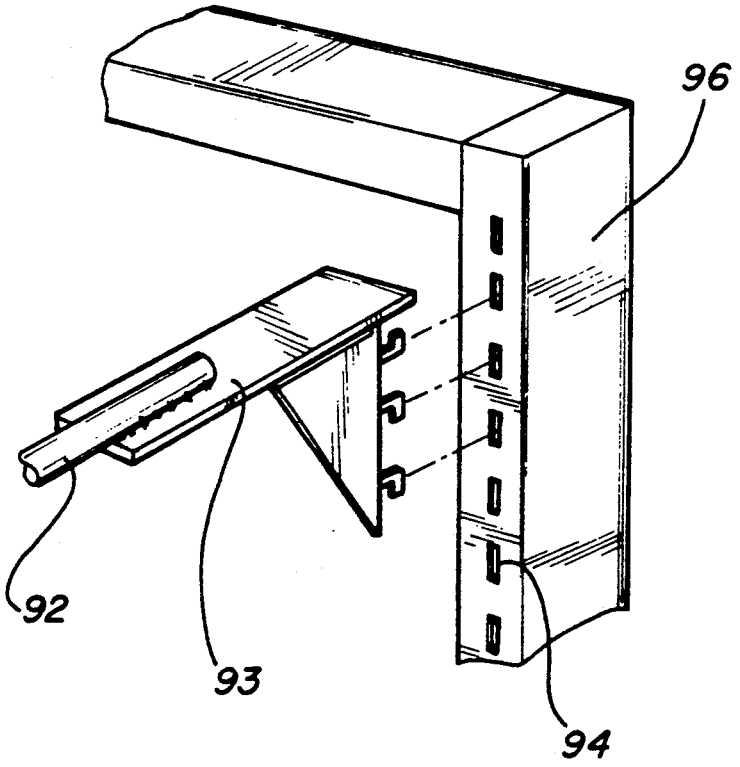
FIG. 12 is a partial perspective view showing how a bracket may be used to mount a construction embodying the present invention.

End caps 78, attached by screws 91, are used to close the end of the fixture bodies 35 where needed. As shown in FIGS. 8 and 12, the support means 37 which are used for mounting the fixture bodies 35, and thus the lighting fixtures 34, in the desired arrangements may take the form of an arm 92 affixed to a bracket 93 which in turn is mountable to slots 94 found in a second bracket 95 on a carousel-type display fixture 96.

One of the advantages of the present invention is that for the first time it unifies several requirements of the retailing art, these being how to provide uniform wall wash, interchangeability of lighting elements, and how to display signage in connection with displays being illuminated. The wide variety of signage which it is possible to display with the present invention can be seen by referring to FIGS. 7–11.

Figure 7:
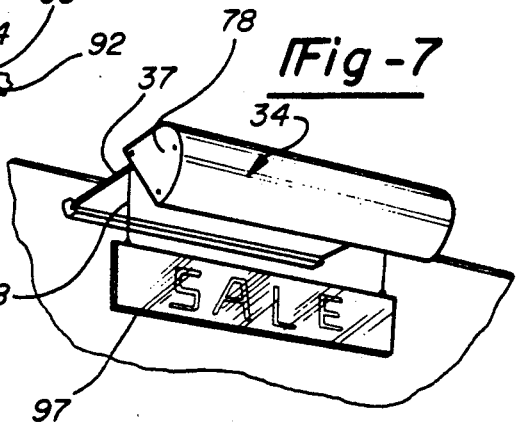
FIG. 7 is a partial pictorial view showing how signage means may be hung from the lighting fixture body of the present invention.
Figure 9:
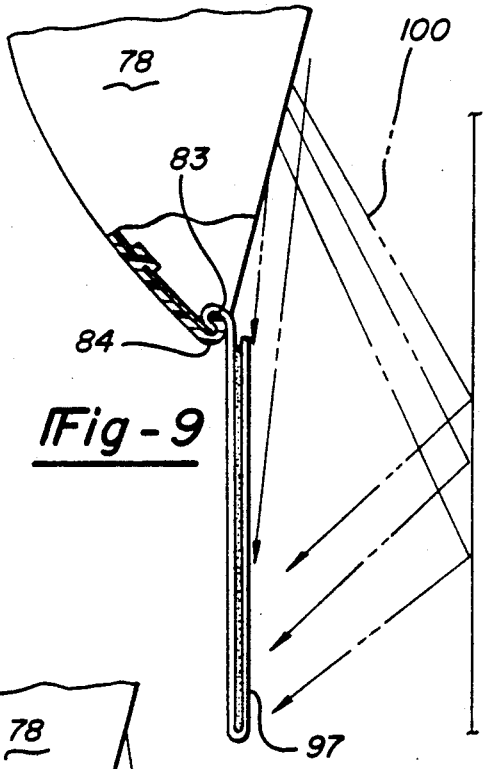
FIG. 9 is an elevational pictorial view partly in section showing how a sign may be suspended from a lip formed in the lower portion of the lighting fixture body.

FIGS. 7 and 8 show a sign 97 suspended by a wire 98 connected to a hook 99 engaging a lip 100 formed on the upper portion 40 of the lighting fixture body 35. This provides illumination of the sign 97 from the front without significantly affecting the amount of illumination reaching the display being illuminated.

Figure 10:
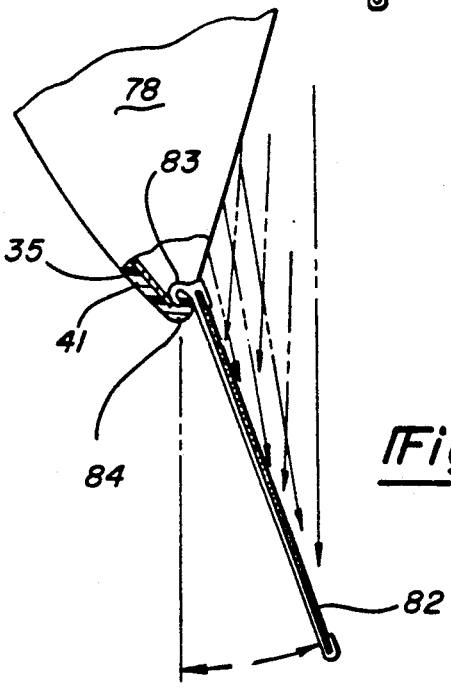
FIG. 10 is a partial pictorial view showing how a sign may be suspended at an angle by a hook engaging a lower lip formed in the lower portion of the lighting fixture body.

If it is desired to have signage means tilted at an angle from the vertical for ease of reading by the customer, the embodiment shown in FIG. 10 may be used where the sign, now designated by the numeral 82, is held at an angle from the vertical by the hook 83 engaging the lower lip 84 formed on the lower portion 41 of the fixture body 35. The same hook 83 engagement means engaging the lower lip 84 may be used in the embodiment shown in FIG. 9 where the sign 97 is suspended vertically from the lower lip 83 as previously described. In this case, since the sign 97 hangs directly vertically from the lower portion 41 of the fixture body, it is illuminated from the rear as can be seen from the ray trace 100 indicated in FIG. 9.

Figure 11:
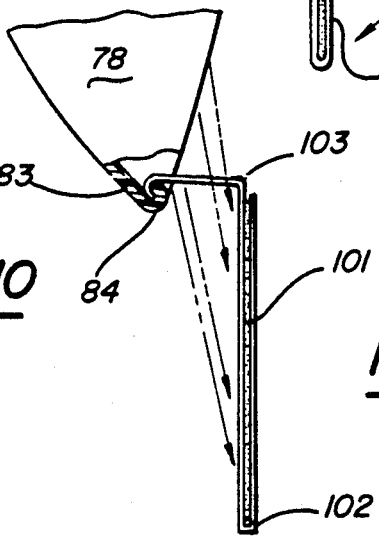
FIG. 11 is a pictorial elevational view partly in section showing how a sign may be suspended to the rear of the lower lip of the lighting fixture body.

If it is desired to have a sign which is illuminated from the front but still engages the lower lip of the fixture body by means of hook 83, the embodiment shown in FIG. 11 can be used wherein the sign 101 is held in a frame 102 having a right angle portion 103 before the lip 83. If the bracket 102 is made translucent and the sign 101 is also made translucent, a front-illuminated sign may be provided for which still does not significantly lessen the amount of illumination reaching the display being illuminated.

Thus, by carefully studying problems longstanding in the illuminating art, I have provided a novel and improved wall wash fixture which is simple in construction, light in weight, has interchangeable lighting modules and reflector portions and in addition can be used for signage display, thus bringing significant advantages to the field over the prior art devices.

I claim:

1. A lighting fixture with changeable reflector portions and snap in lighting modules, said lighting fixture including, in combination:

a) a lighting fixture body having an upper portion, a mid-portion and a lower portion, b) at least one joiner mounting slot on the interior of said body, c) a fixture receiving means on the interior of said body for receiving an interchangeable, snap-in, lighting module, and d) at least one reflector mounting slot on the interior of said body for receiving interchangeable reflectors which are separate from said lighting module.

2. The lighting fixture defined in claim 1, and including a screw receiving slot proximate the mid-portion of said fixture receiving means.

3. The lighting fixture defined in claim 1, and including:

a) at least one exterior mounting slot on the exterior of said body.

4. The lighting fixture defined in claim 3, wherein said exterior mounting slot is on the upper portion of said body.

5. The lighting fixture defined in claim 1, and further including:

a) said at least one joiner mounting slot including a first and a second joiner mounting slot, and
said first joiner mounting slot formed on the interior of said body, on the lower portion thereof,
said second joiner mounting slot formed on the interior of said body, proximate the mid-portion thereof, and b) an exterior mounting slot formed on the exterior of said body, on the upper portion thereof.

6. The lighting fixture defined in claim 5, and further including:

a) a first reflector mounting slot on the interior of said body portion adjacent said first mounting slot, and b) a second reflector mounting slot adjacent said first reflector mounting slot, c) a third reflector mounting slot on the interior of said body opposite said exterior mounting slot.

7. A lighting system including:

a) a plurality of lighting fixtures of the type defined in claim 1, each of said lighting fixtures being attached seriatim to an adjacent lighting fixture by at least one joiner utilizing said joiner mounting slot, and including:

i) at least one reflector mounted in a reflector mounting slot, and ii) at least one lighting module removably mounted to said fixture mounting means.

8. A lighting fixture with changeable reflector portions and snap in lighting modules, said lighting fixture including, in combination:

a) a body having an upper portion, a mid-portion and a lower portion, b) at least one joiner mounting slot formed on the interior of said body, and being integral therewith, c) a fixture receiving means on the interior of said body for receiving an interchangeable, snap-in, lighting module, and d) at least one reflector mounting slot on the interior of said body, and integral therewith, for receiving interchangeable reflectors which are separate from said lighting modules.

9. The lighting fixture defined in claim 8, and including a screw receiving slot formed integrally with said body, proximate the mid-portion of said fixture receiving means.

10. A lighting system including:

a) a plurality of lighting fixtures of the type defined in claim 8, each of said lighting fixtures being attached seriatim to an adjacent lighting fixture by at least one joiner utilizing said joiner mounting slot, and including:

i) at least one reflector mounted in a reflector mounting slot, and ii) at least one lighting module removably mounted to said fixture receiving means.

11. The lighting fixture defined in claim 8, and including:

a) at least one exterior mounting slot on the exterior of said body, and being integral therewith.

12. The lighting fixture defined in claim 11, wherein said exterior mounting slot is formed in the upper portion of said body.

13. The lighting fixture defined in claim 11, and further including:

a) said at least one joiner mounting slot including a first and second joiner mounting slot, said
first joiner mounting slot formed on the interior of said body, on the lower portion thereof, and being integral therewith, b) said a second joiner mounting slot on the interior of said body, proximate the mid-portion thereof and being integral therewith, and c) said exterior mounting slot formed on the exterior of said body, integral therewith, and being on the upper portion thereof.

14. The lighting fixture defined in claim 13, and further including:

a) a first reflector mounting slot on the interior of said body portion, adjacent said first mounting slot, and integral therewith, b) a second reflector mounting slot formed adjacent said first reflector mounting slot, and c) a third reflector mounting slot on the interior of said body, opposite said exterior mounting slot.

15. The lighting fixture defined in claim 14, and further including:

a) a first reflector mounted in said first reflector mounting slot, b) a second reflector mounted in said second reflector mounting slot, and c) a third reflector mounted in said third reflector mounting slot.

16. The lighting fixture defined in claim 15, and further including:

a) a lighting module removably mounted to said fixture receiving means.

17. The lighting fixture defined in claim 16, wherein said fixture mounting means include:

a) a first pair of opposed ridges formed integrally with said fixture body on the interior thereof; to provide an abutment means for a lighting module, b) a second pair of ridges formed integrally with said fixture body on the interior thereof in a one hundred and eighty degree opposed relationship and being spaced a predetermined distance from said first pair of opposed ridges to provide a stop means, and c) at least one pair of spring arms having bosses thereon to snap into said second pair of ridges to retain said lighting module in place in said lighting fixture.

18. The lighting fixture defined in claim 16, wherein said lighting module is a fluorescent light.

19. The lighting fixture defined in claim 16, wherein said lighting module is a lighting track having at least one track light mounted thereto.

20. The lighting fixture defined in claim 16, and further including:

a) an electrical supply means mounted to said lighting fixture adjacent said lighting module to supply power thereto.

21. The lighting fixture defined in claim 20, wherein each of said electrical power supply means includes:

a) a power supply cord to receive power from an adjacent upstream lighting fixture, said power supply cord being approximately the length of said fixture body, b) a first receptacle to receive a power supply cord from an adjacent downstream lighting fixture and supply power thereto, said first receptable electrically connected to said power supply cord, and c) a second receptacle electrically connected to said power supply cord to supply power to said lighting module.

22. The lighting fixture defined in claim 20, wherein said electrical supply means is mounted to said lighting fixture using a screw receiving slot formed proximate the middle of said fixture mounting means.

23. A lighting system including:

a) a plurality of lighting fixtures of the type defined in claim 21, each of said lighting fixtures being attached seriatim to an adjacent lighting fixture by at least one joiner utilizing said joiner mounting slot, and including:

i) at least one reflector mounted in a reflector mounting slot, and ii) at least one lighting module removably mounted ton said fixture receiving means.

24. The lighting fixture defined in claim 20, and further including:

a) sign mounting means formed on said body.

25. The lighting fixture defined in claim 24, wherein said sign mounting means are formed in the upper portion of said body.

26. The lighting fixture defined in claim 25, wherein said sign mounting means include a lip formed on the upper portion of said lighting fixture body.

27. The lighting fixture defined in claim 26, wherein said sign is suspended vertically from said lip.

28. The lighting fixture defined in claim 24, and including fixture support means.

29. The lighting fixture defined in claim 26, wherein said fixture support means include:

a) an exterior mounting bracket, b) a joiner fixedly mounted to said exterior mounting bracket, c) an arm fixedly mounted to said joiner, d) a bracket fixedly mounted to said arm.

30. The lighting fixture defined in claim 24, wherein said sign mounting means are formed on the lower portion of said body.

31. The lighting fixture defined in claim 30, wherein said sign mounting means include a lower lip formed on the lower portion of said lighting fixture body.

32. The lighting fixture defined in claim 31, and including a sign having a hook type engaging means connecting said sign to said lighting fixture by engagement with said lower lip.

33. The lighting fixture defined in claim 32, wherein said sign hangs vertically from said lighting fixture and is illuminated from the rear.

34. The lighting fixture defined in claim 32, wherein said sign hangs vertically from said lighting fixture, but is spaced a distance to the rear thereof, and is thereby illuminated from the front.

35. The lighting fixture defined in claim 32, wherein said sign is suspended at an angle from said lighting fixture by said hook means.

* * * * *